United States Patent [19]

Anderson et al.

[11] Patent Number: 4,813,723

[45] Date of Patent: Mar. 21, 1989

[54] LATCH OPERATING MEANS

[75] Inventors: John N. Anderson, Ipswich; Edward C. Marshall, Eye; Arthur Stoney, Halstead; William Tulloch; Paul L. Duke, both of Colchester, all of England

[73] Assignee: Titon Hardware Limited, Colchester, England

[21] Appl. No.: 826,461

[22] Filed: Feb. 5, 1986

[30] Foreign Application Priority Data

Feb. 5, 1985 [GB] United Kingdom ..... 8502922
Jun. 18, 1985 [GB] United Kingdom ..... 8515401

[51] Int. Cl.[4] ..... E05C 21/00
[52] U.S. Cl. ..... 292/336.3; 74/99 R
[58] Field of Search ..... 292/172, 174, 336.3, 292/DIG. 37, DIG. 62; 74/99 R, 89

[56] References Cited

U.S. PATENT DOCUMENTS 2,484,738 10/1949 Reid ..... 292/172
2,699,353 1/1955 Nagy et al. ..... 74/99 X
3,183,418 5/1965 Cherniak ..... 74/99 X
3,191,780 6/1965 Updegrove ..... 74/99 X
3,264,025 8/1966 Hawes ..... 292/172 X
3,561,805 2/1971 Shaw ..... 292/172
4,193,377 3/1980 Disdier ..... 74/99 R X

FOREIGN PATENT DOCUMENTS 862871 3/1961 United Kingdom .

*Primary Examiner*—Richard E. Moore
*Attorney, Agent, or Firm*—Millen & White

[57] ABSTRACT

Latch operating means are disclosed comprising a linearly moveable operating member and a rotationally moveable latch operating member, interaction means comprising a thread and a thread engaging cam being provided betwen said operating member and said latch operating member, said interaction means translating linear movement of said operating member into rotational movement of said latch operating member: the latch operating means in the various forms of the invention are constructed such that said latch operating member has located rotatably thereon connector means, said connector means and said latch operating means having rotatory loss connection means therebetween; said thread being a groove and said thread engaging cam being a bearing; and being provided with locking means to restrain rotation of said latch operating member.

24 Claims, 10 Drawing Sheets

FIG. 16
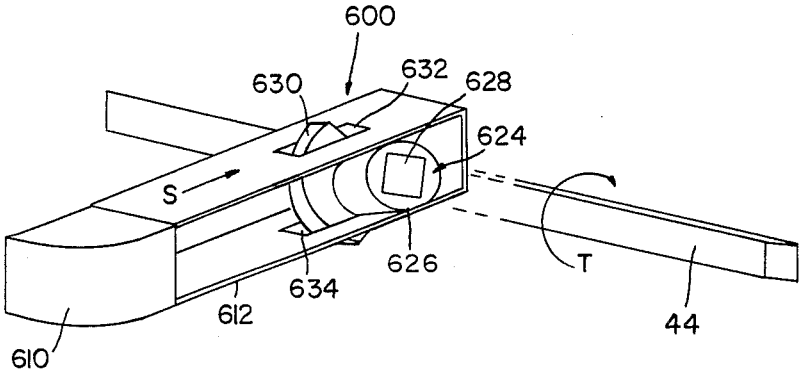
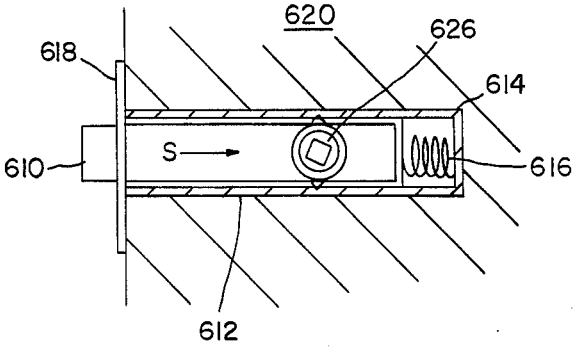
FIG. 17

LATCH OPERATING MEANS

BACKGROUND OF THE INVENTION

This invention relates to operating means for a latch, for example a door latch.

A door latch set as conventionally used comprises an insert fitted in the free edge of the door between its front and back faces having a bolt which in its extended position protrudes beyond the edge of the door into a recess in the door frame and in its retracted position is wholly within the door to allow the door to be opened. The bolt is conventionally moved between its retracted and extended positions by rotation of an element of the latch set by rotation of a square section spindle extending through the door. Rotation of the spindle is usually effected by action of a door handle or knob on the spindle. The bolt will usually be spring biased to its extended position.

The bolt may be lockable in the extended or retracted position by a mechanism which prevents rotation of the handle or knob.

The door handles or knobs conventionally used in these arrangements need to be rotated by the user. There are users for whom and circumstances in which rotation is difficult, inappropriate or undesirable. Therefore efforts have been made to produce arrangements in which a linear rather than rotatory action by the user is required to move the latch bolt between its retracted and extended positions. One such arrangement is provided in UK Pat. No. 862871 in which a press member extends through the door and out of the door on both sides, the press member having inclined cam surfaces which act upon a formation on or connected with the latch bolt, linear movement of the press member causing the latch bolt to retract by a camming action, the latch bolt being spring loaded to the extended position. This arrangements suffers the disadvantage of not using a conventional latch set, and in that movement of the press member on one side of the door causes movement of the other end on the other side of the door.

A further suggestion utilizing a linear movement towards or away from the door to retract or extend the latch bolt is described in Swedish Pat. No. 348700, in which rotation of a conventional square latch spindle is achieved either by rotation of a handle or by pressure on the handle towards the door. In the pressure operated mode a pin and helical groove arrangement translates linear movement of the member carrying the pin into rotary motion of the member carrying the groove, the rotary motion being transmitted through the spindle to the latch set in order to open the door.

A still further suggestion operating on a very similar basis to that of Swedish Pat. No. 358700 is disclosed in UK Pat. No. 2070128 in which the door latch can be moved by pushing a push button. When the handle is pushed, it in turn pushes a drum bearing a pin. The pin engages a helical groove in a slug which is caused to rotate. The slug has a square-section bore through which the latch spindle passes and so the latch bolt is caused to retract.

The arrangements shown in UK No. 2070128 and Swedish Pat. No. 358700 suffer the disadvantage that operation of the mechanism on one side of the door has an effect on the other side of the door. Thus, the two operating actuators do not operate independently. Furthermore, these arrangements require a separate locking device if the door is to be locked.

As with the arrangements shown in UK No. 2070128 and Swedish Pat. No. 358700, the present invention is concerned with operating means intended particularly (but not exclusively) to operate conventional latch sets such as those falling within British Standard BS NO. 5872 (1980), the operating means using linear movement of an operating member towards or away from the door to cause rotational movement of a latch operating member by interaction of a thread on one member with a thread engaging cam on the other member.

SUMMARY OF THE INVENTION

It is an object of the present invention to provide latch operating means, suitable for use with a conventional door latch set e.g. of the type falling within BS NO. 5872(1980), having improved operating characteristics, greater ease and economy of production and enhanced performance particularly when used in pairs one on each side of a door. It is also an object to provide, when required, means to lock the latch operating means.

The present invention is described primarily in terms of operation of latch sets for doors. The operating principles of the various improvements of the present invention may be applied, mutatis mutandis, to other forms of catch/handle/lock arrangements where translation of linear e.g. manual movement to rotational movement is required to bring about an operating effect. Thus the term "door" is not used restrictively and may extend to any similar moveable panel.

The latch operating means the subject of the present invention comprise a linearly moveable operating member and a rotationally moveable latch operating member, interaction means comprising a thread and thread engaging cam being provided between said operating member and said latch operating member, said interaction means translating linear movement of said operating member into rotational movement of said latch operating member, the said latch operating means in various aspects of the invention being provided with one or a combination of the following:

(i) said latch operating member has located rotatably thereon connector means, said connector means and said latch operating means having rotatory lost motion therebetween.

(ii) in which said thread is a groove and said thread engagement cam is a bearing.

(iii) in having locking means to restrain rotation of said latch operating member The latch operating means the subject of the invention may comprise any of these features individually or a combination thereof for example combinations of features (i) and (ii), (i) and (iii), (ii) and (iii) along with (i), (ii) and (iii).

When the latch operating means of the invention is characterised in having the said connector means and said rotatory lost motion means, the said lost motion means preferably comprise a cylindrical recess with one or more part annular extension, and a cylinder with one or more radially extending lug, said cylinder being located for rotation in said recess and said lug being located within said radial extension for angular movement therein e.g. on rotation of said cylinder.

The invention also extends to a latch operating set comprising: a latch set having a latch bolt and a rotational element, rotation of said element causing linear movement of said latch bolt; latch operating means having a linearly moveable operating member and a rotationally moveable latch operating member, interaction means comprising a thread and a thread engaging cam being provided between said operating member and said latch operating member, said interaction means translating linear movement of said operating member into rotational movement of said latch operating member; a latch spindle between said latch operating member and said rotational element for rotation of said rotational element consequent on rotation of said latch operating member; connector means located between said latch operating member and said spindle said connector means and said latch operating means having rotatory lost motion means therebetween. The latch operating set may further comprise a latch set having a latch bolt and a rotational element, rotation of said element causing linear movement of said latch bolt; two latch operating means each having a linearly moveable operating member and a rotationally moveable latch operating member, interaction means having a thread and a thread engaging cam being provided between said operating member and said latch operating member; said interaction means translating linear movement of said operating members into rotational movement of said latch operating members; a latch spindle between said latch operating members of said two latch operating means and said rotational element for rotation of said rotational element consequent on rotation of said latch operating members; and connector means located between each said latch operating means and said spindle, each said connector means and said latch operating means having rotatory lost motion means therebetween.

The latch operating set having two latch operating means as defined above is preferably such that operation of one of said latch operating means causes rotation of said spindle, which rotation is lost by said rotatory lost motion means such that said latch operating member of said other operating means is substantially unmoved.

In the second aspect of the invention, namely when the thread is a groove and the said thread engaging cam is a bearing, the said thread engaging cam may have a roller bearing around its circumferential surface. In a further form the said groove may be located on the latch operating member, said operating member having a recess; and a ball bearing is located between said groove and the said recess, the ball bearing thereby acting as the cam engagement of the respective members. In another form of the invention the thread preferably has a non-constant helix angle.

This aspect of the invention also extends to a latch operating set comprising; a latch set having a latch bolt and a rotational element, rotation of said element causing linear movement of said latch bolt; latch operating means comprising a linearly moveable operating member and a rotationally moveable latch operating member, interaction means comprising a thread and a thread engaging cam being provided between said operating member into rotational movement of said latch operating member; a latch spindle between said latch operating member and said rotational element for rotation of said rotational element consequent on rotation of said latch operating member; in which said thread is a groove and said thread engaging cam is a bearing. The latch operating set may further comprise a latch set having a latch bolt and a rotational element, rotation of said element causing linear movement of said latch bolt, two latch operating means each having a linearly moveable operating member and a rotationally moveable latch operating member, interaction means having a thread and a thread engaging cam being provided between said operating member and said latch operating member; said interaction means translating linear movement of said operating members into rotational movement of said latch operating members; a latch spindle between said latch operating members of said two latch operating means and said rotational element for rotation of said rotational element consequent on rotation of said latch operating members; in which each said thread is a groove and each said thread engaging cam is a bearing.

In the third aspect of the invention, namely when locking means are provided to restrain rotation of the said latch operating member, the said locking means may act directly on the said latch operating member to restrain rotation of it or may act upon the said operating member to restrain linear movement of the said operating member and thereby indirectly restrain rotational movement of the latch operating member.

In a preferred form of this aspect of the invention the said locking means comprises a spacer moveable between a first position allowing linear movement of said operating member and a second position in which said spacer is located between said operating member and said latch operating member so as to maintain linear separation thereof and thereby restrain linear movement of said operating member with respect to said latch operating member.

The said spacer may be located rotationally between said operating member and said latch operating member, said operating member and said latch operating member defining between them a recess, said spacer and said recess being configured such that said spacer in a first rotational position may move linearly into said recess to allow linear movement of said operating member with respect to said latch operating member, but not in a second rotational position.

The said locking means may further be located on or within said latch operating member, said locking means being moveable from a first position allowing rotational movement of said latch operating member and a second position in which said locking means engage a rotationally fixed member of said latch operating means to restrain rotational movement of said latch operating member. The said locking means located on or within said latch operating member may comprise a pin or pins located within said latch operating member and spaced from the axis thereof said pin(s) being moveable between a first, retracted, position and a second position in extending out of the latch operating member into engagement with a rotationally fixed member of the latch operating means to restrain rotational movement of the latch operating member. The said rotational locking member may be provided within the said latch operating member said rotational locking member and said pin(s) having interacting means therebetween comprising an interacting thread on said locking member and thread engaging cam on said pin(s)rotational movement of said rotational locking member being transferred to linear movement of said pin(s) by said interacting means.

This aspect of the invention also extends to a latch operating set which may comprise a latch set having a latch bolt and a rotational element, rotation of said element causing linear movement of said latch bolt; latch operating means, a linearly moveable operating member and a rotationally moveable latch operating member, interaction means comprising a thread and a thread engaging cam being provided between said operating member and said latch operating member, said interaction means translating linear movement of said operating member into rotational movement of said latch operating member and said rotational element for rotation of said rotational element consequent on rotation of said latch operating member; having locking means to restrain rotation of said latch operating member. The latch operating set may comprise a spacer moveable between a first position allowing linear movement of said operating member and a second position in which said spacer is located between said operating member and said latch operating member so as to maintain linear separation thereof and thereby restrain linear movement of said operating member with respect to said latch operating member.

A latch operating set according to this aspect of the invention may comprise a latch set having a latch bolt and a rotational element, rotation of said element causing linear movement of said latch bolt; two latch operating means each having a linearly moveable operating member and a rotationally moveable latch operating member, interaction means comprising a thread and a thread engaging cam being provided between said operating member and said latch operating member, said interaction means translating linear movement of said operating member into rotational movement of said latch operating member; a latch spindle between said latch operating members of said two latch operating means and said rotational element for rotation of said rotational element consequent on rotation of said latch operating members; in which each said locking means comprises a spacer moveable between a first position allowing a linear movement of said operating member and a second position in which said spacer is located between said operating member and said latch operating member so as to maintain linear separation thereof and thereby restrain linear movement of said operating member with respect to said latch operating member; means provided to connect said spacers such that movement of said spacer of on said latch operating means causes movement of said spacer of the other said latch operating means between its first and second positions.

A further latch operating set may comprise latch operating means as defined above together with further latch operating means; and means provided to connect said first and said further latch operating means such that operation of said locking means of said first latch operating means restrains said further latch operating means from operation. In this spacer means may be provided between said latch operating member and said latch operating member of said first latch operating means and connection means provided between said spacer and said further latch operating means; rotation of said spacer causing linear movement of said connection means to or from a position where it restrains said further operating means from operation.

The latch set used in or connection with any of the aspects of the invention may be of a conventional type, for example as falling within BS NO. 5872(1980) using a square section spindle. Where lost motion is provided as described above the extent of angular or rotatory lost motion is preferably equivalent to the angular rotation of the latch operating member required to operate the latch set. The thread in each case may preferably have a non-constant helix angle.

It will be appreciated that in any of the various aspects and forms of the invention, while it may be preferred to bring about the retraction of the latch bolt by pressure on a push button towards the door, the reverse arrangement may usually be provided whereby retraction of the latch bolt is effected by pulling the operating member away from the door. Thus references to "push buttons" and the like throughout this specification may as appropriate be replaced, mutatis mutandis, by reference to pulling.

The latch operating member axis is parallel to and preferably substantially coincident with the linear movement path of the operating member.

In further forms of the invention alternative combinations of thread and thread engaging cam may as appropriate be utilized. For example the thread may instrad of a groove be a helical flange standing proud of one operating member mating in a manner to permit sliding with further means attached to the other operating member, for example a twin pin or pin and bearing arrangement, the pins being spaced in a manner sufficient that the helical flange may run between them.

In any of the aspects or forms of the invention there may be a plurality of threads and thread engaged cams. In a preferred form there are two such threads and thread engaged cams at approximately 180° from each other about the cylindrical member axis.

BRIEF DESCRIPTION OF THE DRAWINGS

The invention may be carried into practice in various ways and some embodiments will now be described, by way of example, with reference to the accompanying drawings in which:

FIGS. 16 and 17 are respectively an isometric sketch of a part of a standard conventional latch set for use with the latch operating means of any of the above drawings.

DESCRIPTION OF THE PREFERRED EMBODIMENTS

Figure 1:
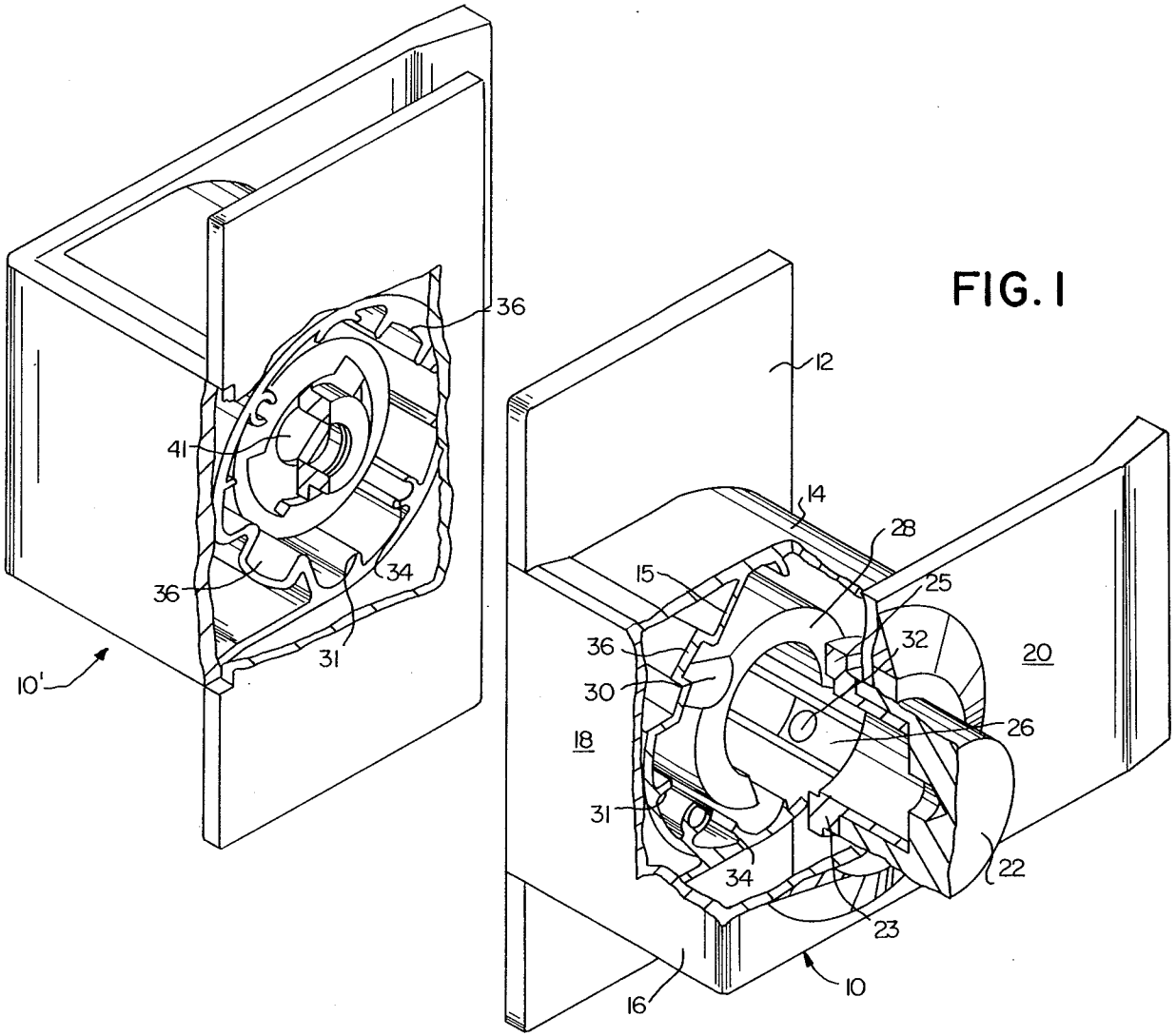
FIG. 1 is a partially cutaway isometric sketch of a pair of door latch operating means of the general type with which the present invention is concerned in position but with the door omitted for clarity.

FIG. 1 shows two latch operating means which hereafter will generally be termed "handles" 10,10' for reasons which will become apparent. Since the working parts of handles 10 and 10' are mirror images only handle 10 will be described in detail though the significance of the mirror image relationship will be discussed.

Figure 2:
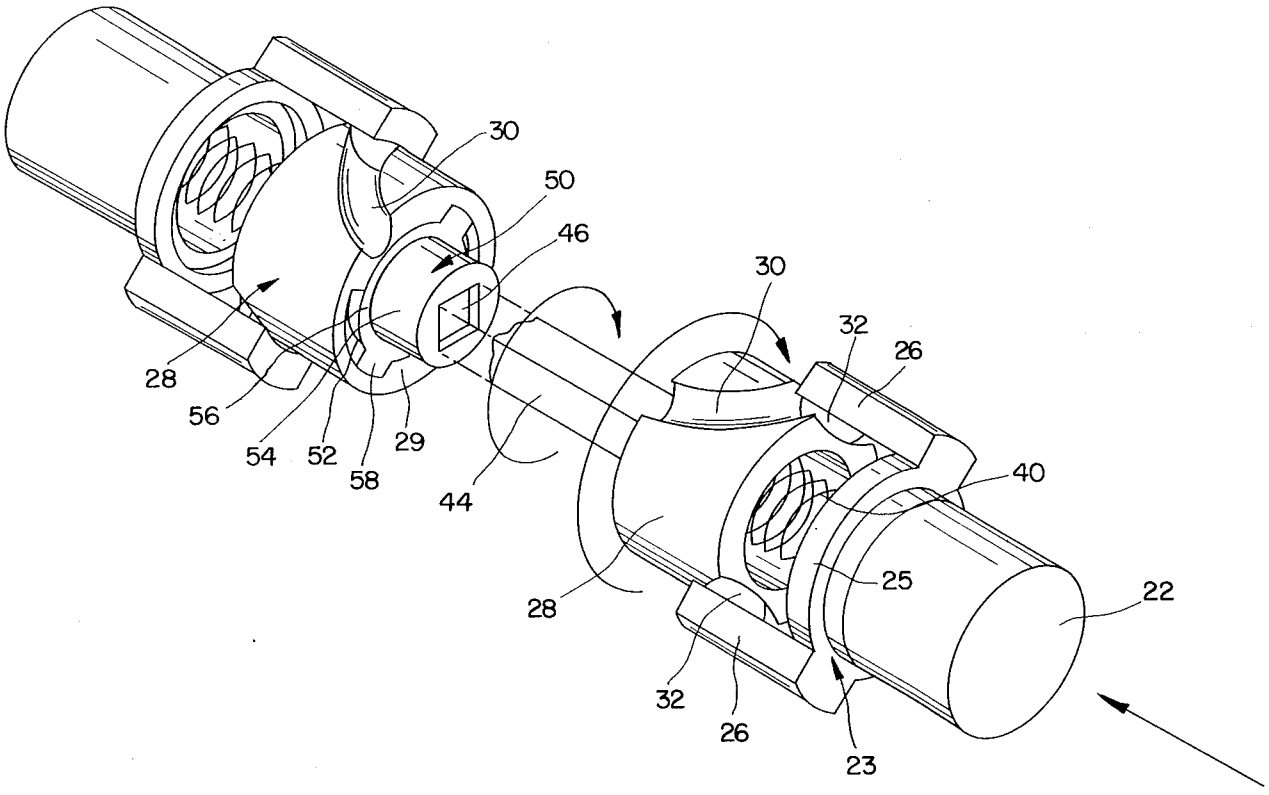
FIG. 2 is an isometric sketch of the operating members and latch operating members of the pair of operating means of FIG. 1 but with the external housings removed.

A conventional latch set according to British Standard BS NO. 5872(1980) will be disposed between the handles 10 and 10' and the latch set provided with a spindle 44 of square section (see FIG. 2)

Referring to FIGS. 1 and 2, the handle 10 has a backing plate 12, and a handle housing formed by an outer casing 14 and a surface piece 16. The backing plate 12 is fixed to the door by screws through screw holes (not shown) which in the assembled handle 10 are obscured from view behind the outer casing 14. The backing plate also has an aperture (not shown) through which the latch spindle 44 passes. The surface piece 16 has two faces at right angles; a lateral face 18 which extends from the edge of the door along one side of the outer casing 14, and a face plate 20 which extends over the front of the outer casing 14 and has an aperture through which a push button 22 passes. The face plate 20 also has an extension beyond the casing 14 so that it may easily be grasped by a user.

The push button 22 is connected to a yoke 23 formed of two axially extending arms 26 as will be seen more clearly in FIG. 2. There is an annular collar 25 of greater diameter than the hole in the face plate 20 which limits the linear movement of the button 22 and yoke 23 away from the base plate 12.

Between the arms 26 is located a cylindrical slug 28 having two helical grooves 30, the grooves being spaced by 180° from one another about the slug 28. The arms 26 are likewise spaced from one another by 180°.

Between each arm 26 and its adjacent groove 30 is held captive a ball bearing 32. Each ball bearing 32 is located in an appropriately configured cavity on the radially inner face of an arm 26 and on appropriately configured groove 30. The casing 14 is provided with an inner casing 15, the outer casing 14 and the inner casing 15 being preferably integral with one another.

The inner casing 15 is formed with a pair of axially extending tracks 36 and a series of axially extending spaced ribs 31,34. The axially extending arms 26 of the yoke 23 fit in the tracks 36 so that the yoke 23 is free to slide axially with respect to the casing 14,15 but is prevented from rotating.

The slug 28 is in the form of a hollow cylinder located within the inner casing 15 by means of the spacing ribs 31,34. The radially inner ends of the ribs 31,34 form in effect a cylindrical location framework for the slug 28 locating the slug 28 but allowing it to rotate about its axis. The slug 28 is open at the outer end (facing the button 22), but is partially closed at the inner end (facing the door) by a wall 29 which has a central opening 41 sufficiently large to accommodate the latch spindle 44.

Means (not shown) may be provided within the casing 14/15 to restrain the slug 28 from movement in an axial/longitudinal direction towards the door.

A compression spring 40 acts between the button 22 and the wall 29 of the slug 28 to bias the slug 28 towards the backing plate 12 and the button 22 away from the back plate 12 towards face plate 20.

Figure 2A:
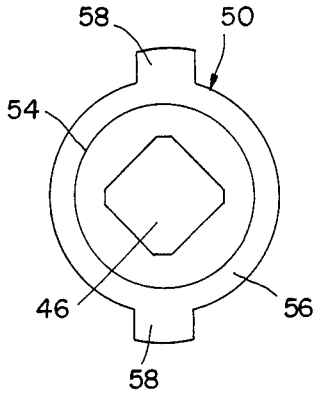
FIG. 2A is an end view of a latch actuator.
Figure 2B:
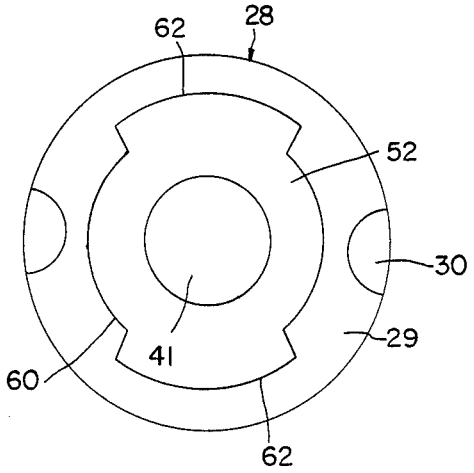
FIG. 2B is an end view of the latch operating member.

A lost motion connector 50 is provided in the form of a collett having a cylindrical barrel 54 and a radial flange 56. The barrel 54 has a square-sectioned aperture 46 which receives the latch spindle 44 non-rotationally. As shown in FIGS. 2A and 2B, the flange 56 has two equispaced radial tabs 58. The connector 50 is located in a recess 52 formed in the end wall 29 of the slug 28, the recess having a circular portion 60 dimensioned to receive the flange 56 and two radial part annular extensions 62 dimensioned to receive the tabs 58. The extensions 62 extend through a greater arc than the tabs 58 thereby allowing limited rotation of the connector 50 with respect to the slug 28. The slug 28 is therefor prevented from axial movement towards the door by the abutment of the barrel 54 against the backing plate 12, and is restrained from axial movement away from the door by the spring 40.

Operation of the device to turn the latch spindle 44 and so withdraw the latch bolt to enable the door to be opened is achieved simply by pressing the button 22. The mechanism works as follows:

Pressure on the button 22 moves the yoke 23 towards the door and at the same time compresses the spring 40. There is sufficient axial clearance between the yoke 23 and the slug 28 to allow the yoke 23 to move in this way. The movement would tend to make the arms 26 rotate to follow the grooves 30 due to the interaction between the yoke 23 and the slug 28 brought about by the ball bearings 32; however, the arms 26 of the yoke 23 are constrained to move only axially by the tracks 36. Furthermore, the slug 28 is prevented from moving axially towards the door by the presence of the back plate 12 and so the interaction between the arms 26 and the grooves 30 through the ball bearings 32 results in rotation of the slug 28 as the yoke 23 moves axially.

Rotation of the slug 28 causes the connector 50 to rotate by virtue of the tabs 58 engaging the respective extremities of the radial extensions 62 of the recess 52. This in turn rotates the latch spindle 44 and so withdraws the latch bolt. The direction of rotation is shown by the arrows in FIG. 2. When the pressure on the button 22 is released, the spring 40 and the latch bolt spring (not shown), if any, return the latch set to the bolt-extended position.

The significance of the lost motion coupling between the connector 50 and the slug 28 can be most clearly understood upon consideration of the left hand part (handle 10') of FIG. 2. Bearing in mind the fact that the two slugs 28 are mirror images, it will be appreciated that the connector 50 and slug 28 in the right-hand portion will be in the same relative rotational positions as those in the left-hand portion. Thus, rotation movement of the right-hand slug 28 in the direction of the arrows will result in immediate rotation of the right-hand connector 50 and in turn of the latch spindle 44.

Now, rotation of the latch spindle 44 will also cause rotation of the left hand connector 50. However, instead of transferring this rotation to the left hand slug 28, the left hand connector 50 merely rotates taking up the lost motion allowed by the additional angular extent of the recess extensions 62 over and above the angular extent of the tabs 58. As a result, operation of the mechanism on one side of the door is entirely independent of the mechanism on the other side of the door (and vice versa) and so there is no tendency to rotate the other slug 28 nor to pull the other button 22 against its spring 40. Consequently, the operation can be smooth and easy to effect.

The mirror image relationship of the slug 28 also means that operation of the mechanism on either side of the door will cause rotation of latch spindle 44 in the same sense. This can also be seen most clearly in FIG. 2.

Care of course needs to be exercised on assembly of the handles 10,10' to ensure that lost motion in the correct sense is provided between the cooperating mechanisms.

Figure 3:
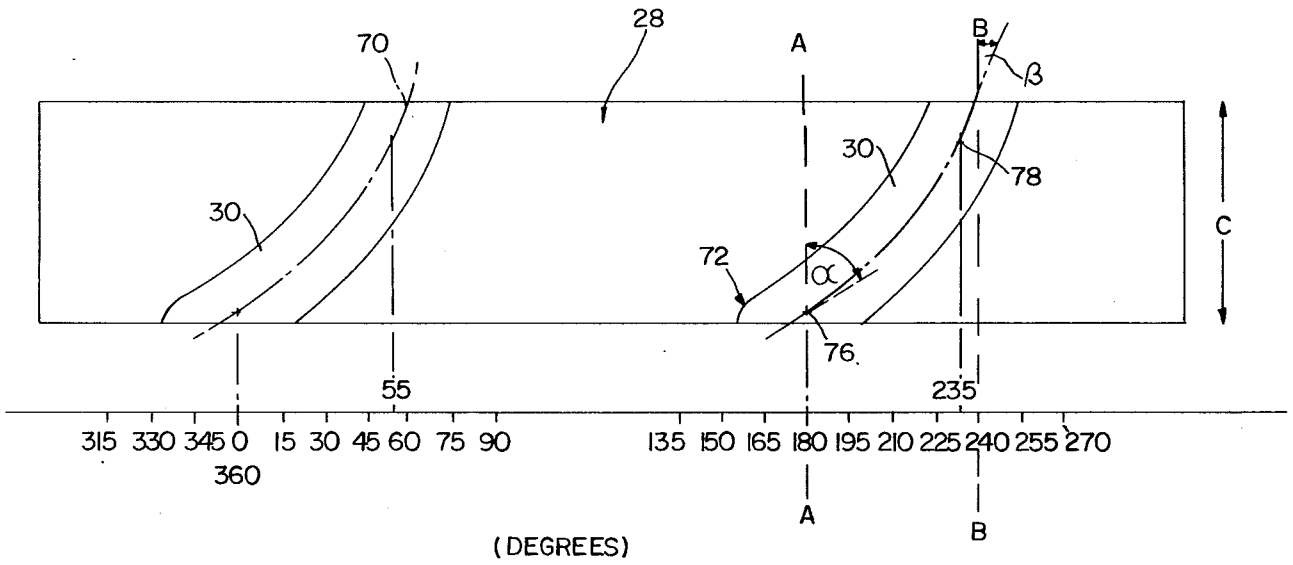
FIG. 3 shows a development of the peripheral surface of the latch operating member shown in FIG. 2, showing the helical grooves on the surface of the latch operating member.

FIG. 3 is a development of the surface of the slug 28 showing one configuration which may be used for the two grooves. The grooves are from substantially semicircular in section, the section being taken substantially at right angles to the pitch line 70 of each groove. The pitch line is in effect the centre line of the groove In the arrangement shown in FIG. 3, the pitch line 70 is an arc of a circle. The helix angle is the angle between the tangent to the pitch line 70 at any point and a line on the surface of the slug 28 parallel to the slug axis. Such a line is shown as A—A. The pitch angle at the start of the thread 30 is designated $\alpha$. The helix angle at the end of the thread 30 is designated $\beta$ that being the angle between a tangent to the pitch line and the line shown at B—B. In this particular embodiment of the invention $\alpha$ is approximately 65°, $\beta$ is approximately 35° and the mean helix angle is about 47°. It will therefore be seen that the helix angle of the grooves 30 across the slug 28 decreases from start to finish.

The two grooves 30 shown in FIG. 3 are substantially identical. The cusp shown at 72 is merely a consequence of the machine operation used to produce the groove. It otherwise has no consequence in the operation of the invention.

British Standard BS NO. 5872(1980) pertaining to latch sets requires a maximum rotational angle of the latch spindle of 50° to operate retraction of the latch bolt. On the drawing, points 76 and 78 show respectively the starting and finishing rest position of the centre of the ball bearings 32, both of which of course require to be within the length of the slug 28 shown at C in order to retain the ball bearing 32 captive between the groove 30 and the cavity in the associated arm 26. The angular rotation between points 76 and 78 is in excess of 50° at 55° to 60° thereby adequately providing the required 50° BS requirement.

It will be appreciated that the corresponding projections for the slug 30' are mirror images of those shown in FIG. 3.

Figure 2C:
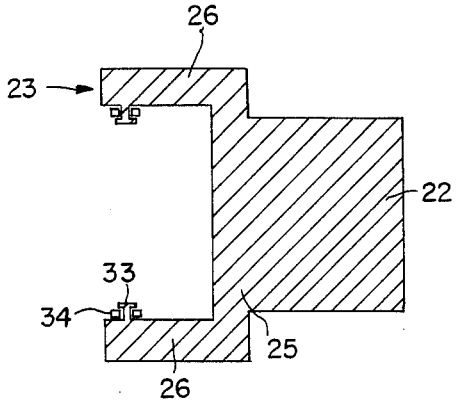
FIG. 2C is a section of a further yoke and bearing arrangement.
Figure 2D:
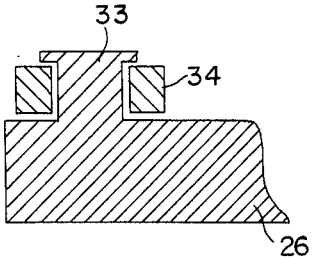
FIG. 2D is an enlarged section of the bearing of FIG. 2C.

FIGS. 2C and 2D show a push button 22 and yoke 26 arrangement in which the ball bearing 32 is replaced by a pin 33 and roller bearing 34. The slug 28 in this embodiment will have grooves 30 with appropriate dimensions such that the bearings 34 roll along the side walls thereof, the arrangement otherwise functioning as described above.

In a further embodiment of the invention (not shown) the push button 22 is provided with means by which it can be grasped by a user and pulled rather than pushed. In that form the rest position will be with the bearings 32 or 34 at the inner end of the slug 28, e.g. at 78, appropriate spring or other biassing means being provided.

FIGS. 4 to 7 show a locking mechanism for the latch operating arrangement described above with reference to FIGS. 1 to 3. In this embodiment, the latch operating arrangement can be locked and unlocked from one side only (the active side), shown on the left in FIGS. 4 and 5. Such an arrangement may be used for example on French Doors.

The locking mechanism comprises an active locking member or spacer 111, a passive locking member or spacer 112 and a square section shaft 113. The shaft 113 extends through a bore in the latch spindle 44, in which it is free to rotate and move axially. It is rigidly connected to the active locking member 111 but passes slidably through a correspondingly square-sectioned hole in the passive locking member 112 thereby preventing relative rotation.

Figure 6:
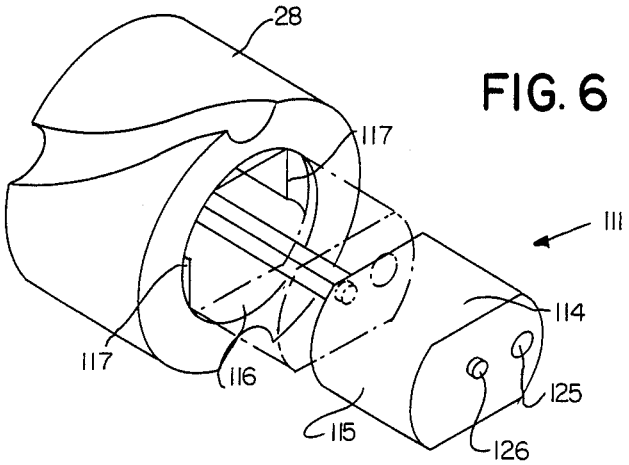
FIG. 6 is an isometic sketch of a locking member in the unlocked orientation.
Figure 7:
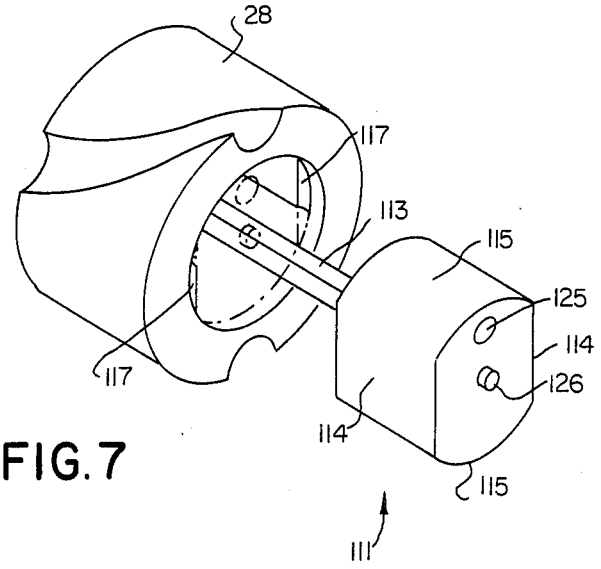
FIG. 7 is an isometric sketch of a locking member in the locked orientation.

The locking members 111, 112 are each part cylindrical and part rectangular in section, in that each has two parallel planar faces 114 and two curved faces 115 forming part of the same cylinder. Each slug 28 has a generally cylindrical bore 116 corresponding to the curved faces of a locking member 111, 112. The bore 116 additionally includes a pair of longitudinal ridges 117. The ridges 117 are arranged to prevent the locking member e.g. 111 from entering the bore 116 in one orientation, as shown in FIG. 6, while allowing the locking member to enter in another orientation, as shown in FIG. 7. The ridges 117 are also shaped to allow the locking member a limited degree of rotation when within the bore—anticlockwise in FIG. 7.

On the active side, the locking button 122 is mounted for rotation with respect to the yoke 23 through an insert 118. The button 122 and insert 118 are therefor rotatable relative to the yoke 23 and are prevented from axial movement outwards from the yoke 23 by means of an annular flange 119 on the insert 118.

The insert 118 has on its inner face a pip 123 and a central hole 124. The active locking member 111 has a corresponding identation 125 and central boss 126. The insert 118 and locking member 111 are urged into engagement by a spring 140 which corresponds to the spring 40 in the construction shown in FIGS. 1 and 2, acting between the locking member 111 and the interior of the slug 28. Thus, relative rotation between the insert 118 and the locking member 111 is prevented and rotation of the button 122 will cause rotation of the locking member 111.

On the non-active side, there is a hollow cylinder 127 between the passive locking member 112 and the button 22, the member 112 being urged towards the button 22 by a second spring 140 in the same way as the active locking member 111.

The relationship between the yokes 23, slugs 28 and latch mechanism in this construction is other wise identical to that described with reference to FIGS. 1 and 2 above. The system as a whole operates as follows:

In the unlocked mode, the locking members 111, 112 are positioned relative to their slugs 128 as shown in FIG. 7. Axial movement of the locking button 122 will cause movement of the associated yoke 23 which in turn causes its slug 28 to rotate and so on to operate the latch set as previously described. This axial movement is permitted by the active locking member 111 entering the slug bore 116 with sufficient relative rotation between the slug 28 and locking member 111 for the slug 28 to rotate being allowed by the shape of the ridges 117. As the locking member 111 moves axially, the shaft 113 moves with it and slides through the passive locking member 112 and into the cylinder 127, without rotating.

If the button 22 is pushed, the latch mechanism is operated in a similar manner, the passive locking member 112 entering its slug bore 116 by moving axially relative to the shaft 113 which is accommodated within the cylinder 127. Again, sufficient relative rotation between the locking member 112 and its slug 28 is allowed by the ridges 117 for that slug 28 to rotate to turn the latch spindle.

In order to lock the mechanism, the locking button 122 is turned through 90° relative to its yoke 23, the yoke 23 being prevented from rotation by the rails 36 in the casing 14,15. The slug 28 remains stationary with the yoke 23, but the active locking member 111 turns with the locking button 122, by virtue of the interacting pip 123, hole 124, indentation 125 and boss 126, until it attains an orientation relative to the slug 28 as shown in FIG. 6. In this position the ridges 117 obstruct axial movement of the locking member 111 such that it cannot enter the slug cavity 116 and thereby prevents the yoke 23 from moving axially. Thus, the slug 28 cannot be caused to rotate and the door latch cannot be released using the locking button 122 The slug is thus restrained from rotation by the locking member 111 acting as spacer between the yoke 23 and the slug 28 and restraining linear movement.

At the same time, rotation of the active locking member 111 rotates the shaft 113 which in turn rotates the passive locking member 112 into the position shown in FIG. 6. Thus, axial movement of the yoke on the non-active side is also obstructed by the same means, so preventing operation of the latch mechanism using the button 22.

Figure 5:
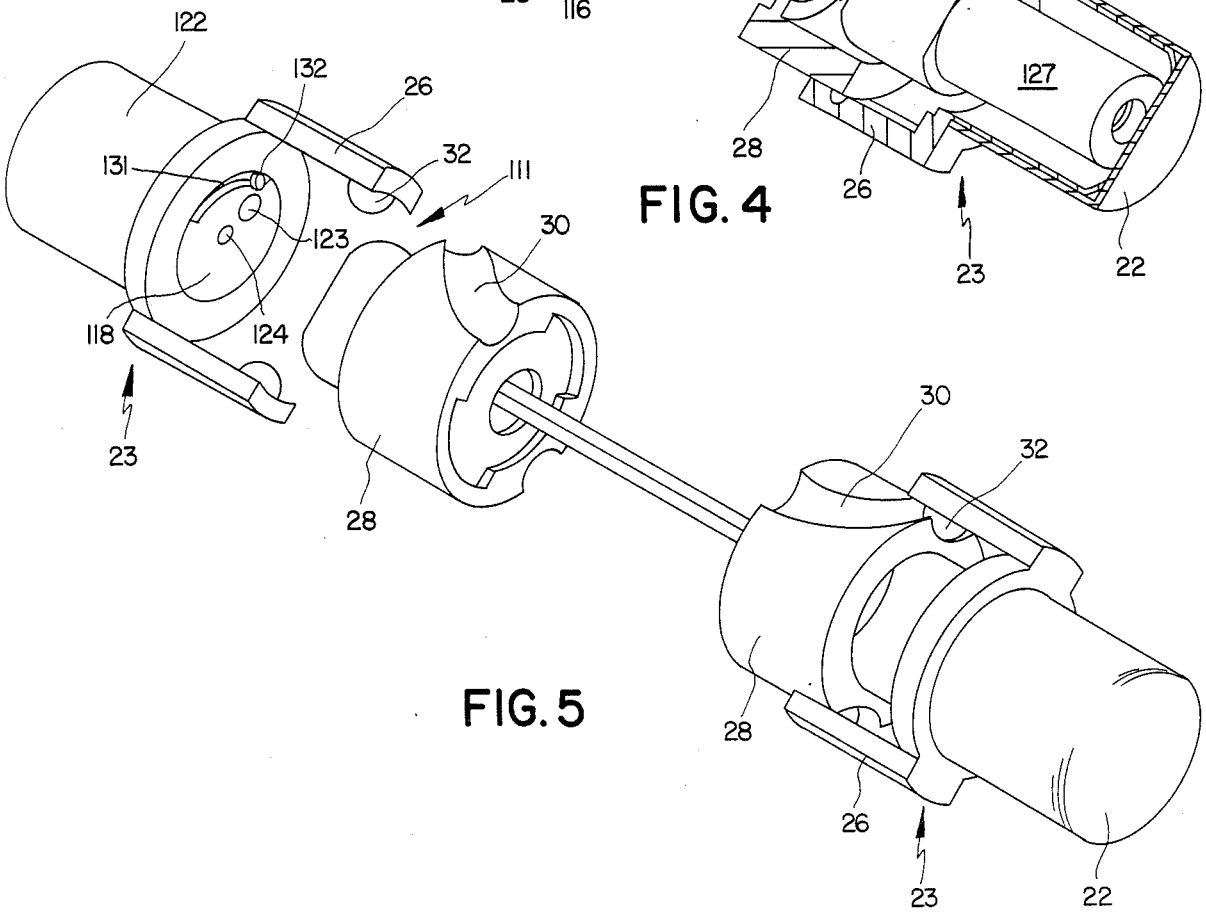
FIG. 5 is an isometric view corresponding to FIG. 4.

In order to limit rotation of the locking button 122 to angle required by the positioning of the ridges 117, in this case 90°, an annular slot 131 is provided in the insert 118 into which a pin 132 extends—see FIG. 5. The pin 132 is fixed relative to the yoke 23 and the slot 131 is so dimensioned to limit the relative rotation as required. An indication or marker (not shown) is provided on the button 122 to show the rotational position of the locking button, i.e. locked or unlocked.

Figure 8:
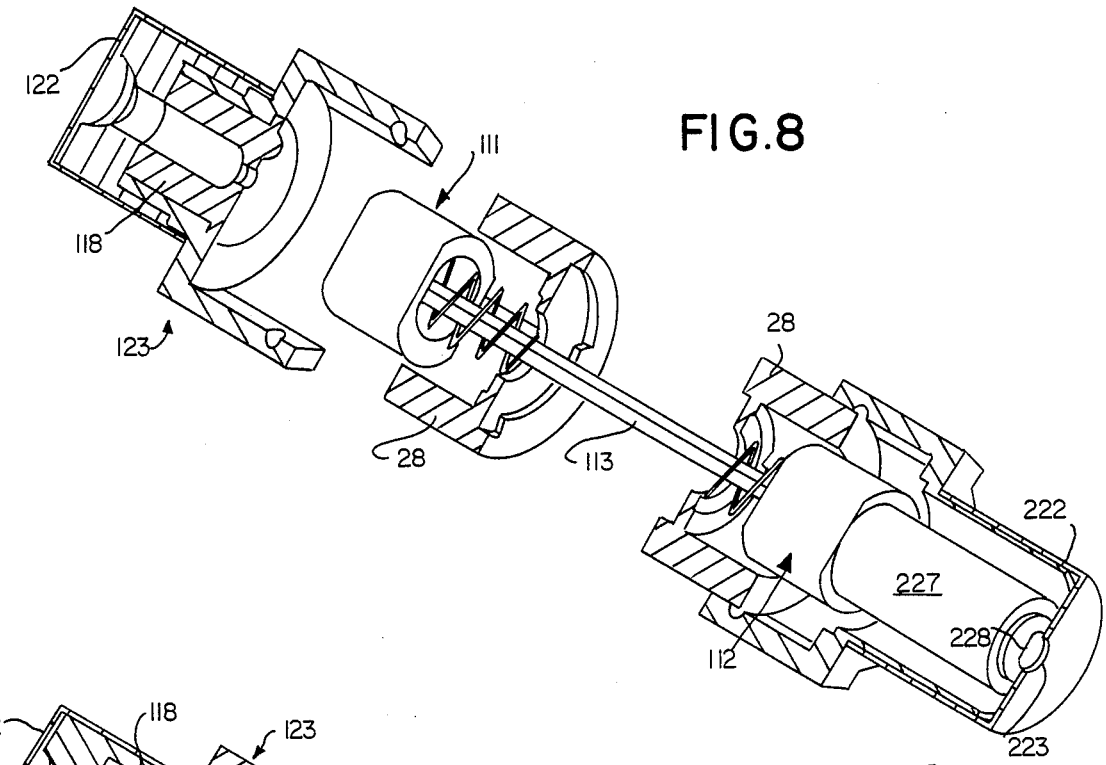
FIG. 8 is a view similar to FIG. 4 showing a second embodiment.

The embodiment shown in FIG. 8 is very similar to that shown in FIGS. 4 to 7 but is intended for use in applications where a door is required to be lockable and unlockable from one side, and unlockable in emergencies from the other side. An example of such an application is a bathroom door.

This embodiment only differs in that the button 222 at the non-active side has a hole 223 and the spacer 227 has a slot 228 at the end adjacent the end of the button 222. Thus, in an emergency, a tool such as a screw driver can be inserted into the slot 228 through the hole 223 and turned, in order to turn the cylinder 227 and so the two locking members 111, 112, thereby unlocking the mechanism.

Figure 9:
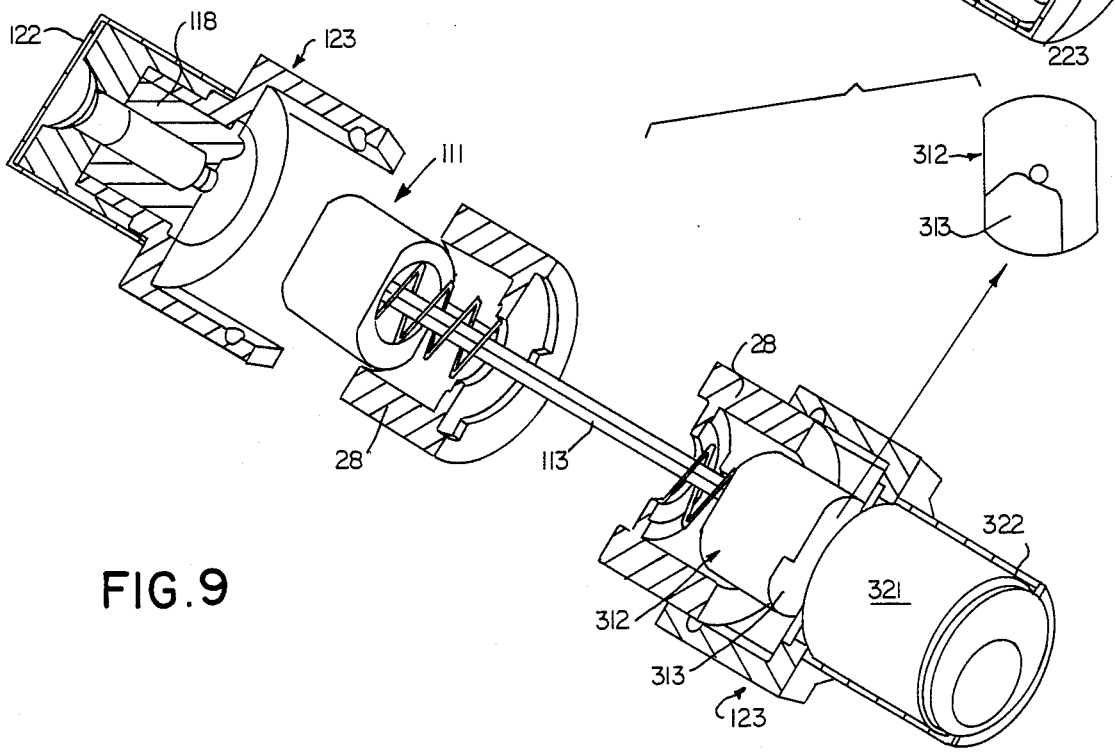
FIG. 9 is a view similar to FIG. 4 showing a third embodiment.

The embodiment shown in FIG. 9 is again similar to that shown in FIGS. 4 to 7 but in this case is intended for use on doors which can be locked in the way described above from one side and locked using a key from the other side. This arrangement may be used on domestic front doors.

This embodiment differs in that the previously described non-active side is active, being arranged to lock-/unlock the mechanism by means of a standard key operated tumbler lock 321. This is located within the button 322 and replaces the cylinder 127, 227. The key acts either directly or indirectly on a second active locking member 312 to rotate the locking member 312 as described above and thereby to lock or unlock the mechanism. The locking member 312 has a cut-out 313 into which a spigot (not shown) on the lock cylinder operated by the key extends, the cut-out 313 being so shaped as to allow the key to return to its insertion/-withdrawal position without moving the locking member 312 after moving the locking member 312 to the desired position.

Figure 10:
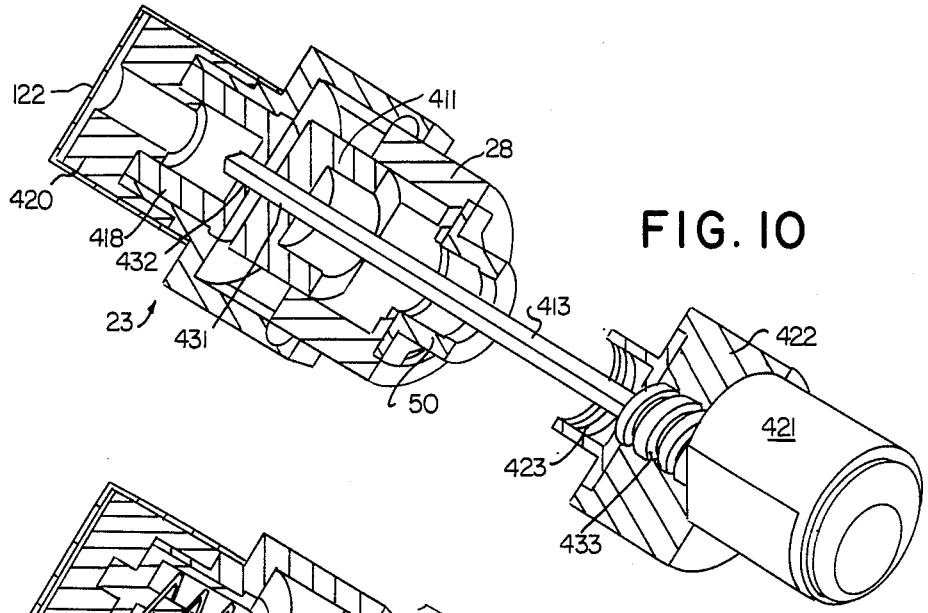
FIG. 10 is a view similar to FIG. 4 showing a fourth embodiment.
Figure 11:
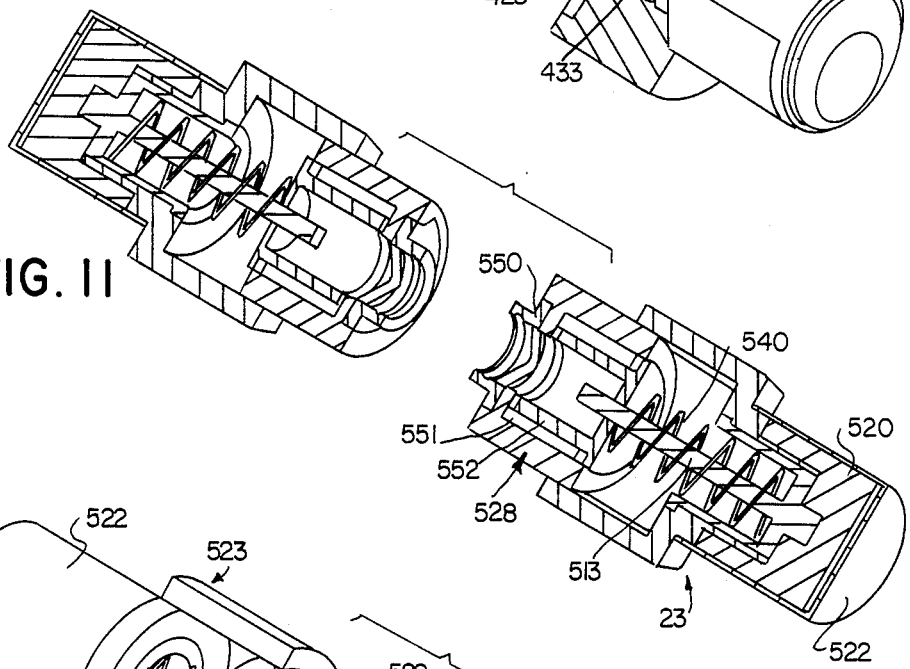
FIG. 11 a view similar to FIG. 4 showing a fifth embodiment.
Figure 12:
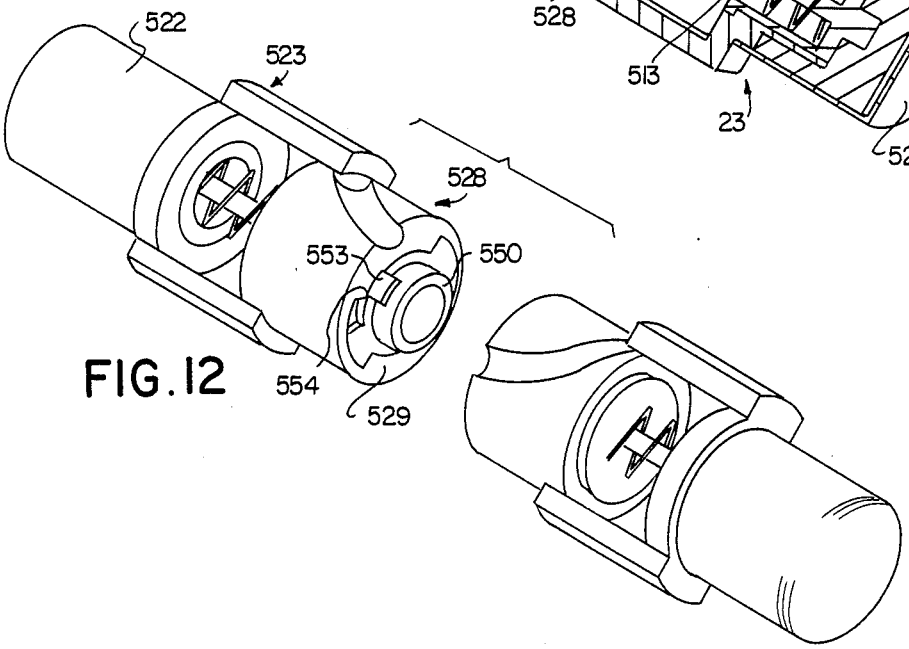
FIG. 12 is an isometric view corresponding to FIG. 11.

The embodiment shown in FIG. 10 is intended for use in those circumstances, such as with hotel doors, where the door is latch operated and lockable as described above from inside, the latch being operable from the other side using rotation by key rather than by a push button mechanism. In addition, it is arranged so that when locked from the inside using the button-operated locking mechanism, the outside key operated lock is prevented from operating the latch, unless a special key is used.

In the embodiment of FIG. 10, the righthand latch operating means is replaced entirely by a standard five pin tumbler lock 421 to the mechanism of which block 422 is attached. The block 422 has a square sectioned aperture 423 which engages the latch spindle (not shown) so that rotation of the block 422 by operation of a key in the lock operates the latch set in a conventional manner.

Figure 4:
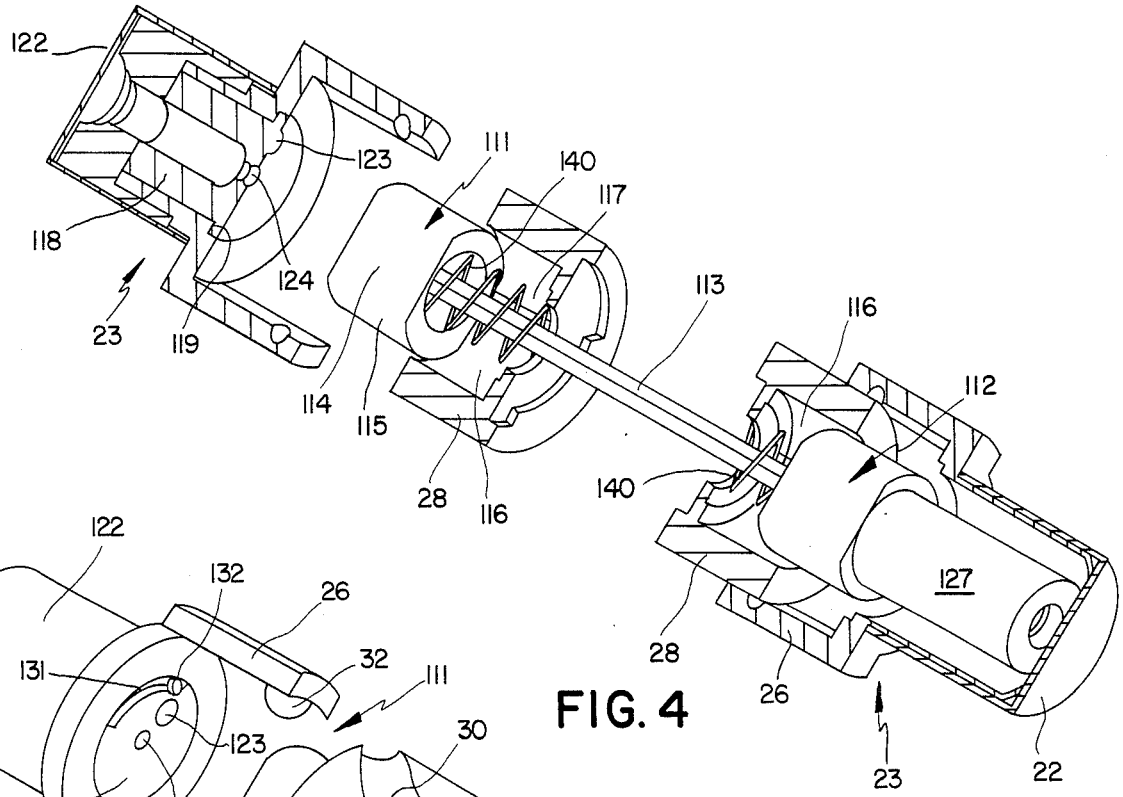
FIG. 4 is an isometic sketch, partially in section, of a locking mechanism in accordance with the invention for use with the latch operating apparatus of FIGS. 1 and 2.

The lefthand or active side is modified from that described e.g. in relation to FIG. 4 in that the shaft 413 passes slidably through correspondingly square-sectioned holes 431,432 in the active locking member 411 and the insert 418 respectively and is accommodated within a hollow cylinder 420 fixed to the button 122 and the insert 418 when the button 122 is pushed to operate the latch mechanism. However, the latch operating and locking functions are similar to those described above.

The shaft 413 is connected to the block 422 through a fast helix 433. Thus, when the locking button 122 is turned to lock the locking mechanism, the shaft 413 is also turned. This in turn causes the fast helix 433 to draw itself and the shaft 413 into abutment with the end of the lock 421. Relative rotation between the fast helix 433 is ensured as the block 422 is prevented from rotation by its engagement with the latch spindle which is itself prevented from rotation by the slug 28 which cannot rotate since the yoke 23 cannot move axially.

Standard keys for the five-pin tumbler lock 421 in this instance are of six-pin length. Thus, when the fast helix 433 abuts the end of the lock 421, the key cannot be inserted to the extent necessary for it to be allowed to turn, and so the latch mechanism cannot be operated. However, in this instance, a special key is provided of five pin length and so when inserted into the lock 421, it is not obstructed by the fast helix 433. Thus the special key can turn the block 422 and so operate the latch mechanism via the latch spindle. When unlocked rotation of the latch spindle is accommodated in the left-hand side of the mechanism by virtue of the lost motion between the connector 50 and the slug 28. The locking member 411, insert 418, cylinder 420 and button 122 all rotate with the shaft 413 without obstruction.

The embodiment shown in FIGS. 11 to 15 is a dual-consent arrangement intended for use on an adjoining door e.g. between two rooms, in which both the doors may be locked from either side but must be unlocked from both sides for the latch mechanism to be operable. The two sides are identical and so only one will be described in detail.

As in earlier embodiments, the latch operating mechanism comprises a button 522 a yoke 23, a slug 528, a spring 540 and a lost motion connector 550. These function in a similar fashion to the earlier embodiments described.

Figure 13:
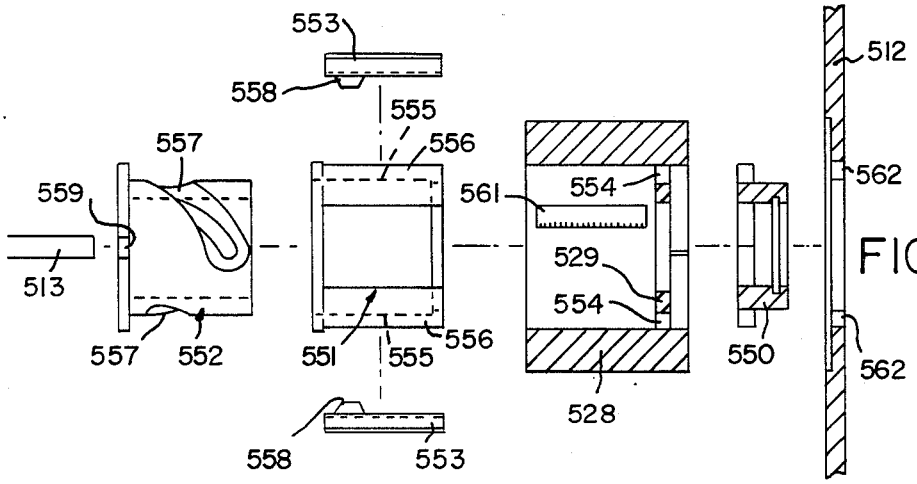
FIG. 13 is an exploded view, partially in section of the locking mechanism shown in FIG. 12.
Figure 14:
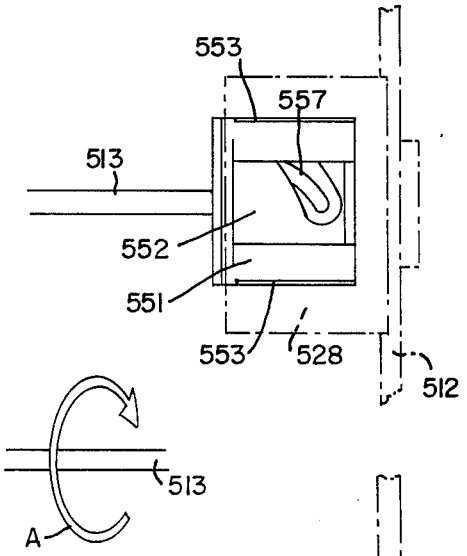
FIG. 14 is a side view of the locking mechanism shown in FIG. 13, in its assembled form in the unlocked condition.
Figure 15:
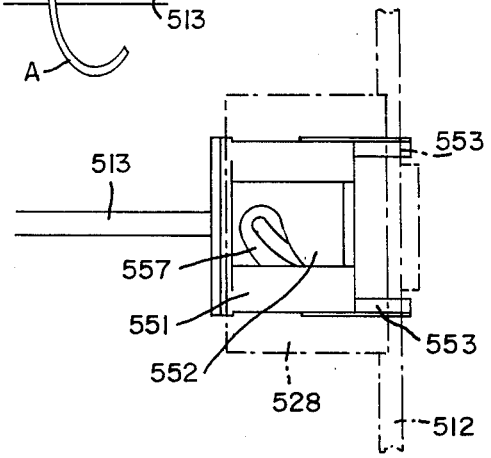
FIG. 15 is a view similar to FIG. 14 showing the mechanism in the locked condition.

The locking mechanism comprises a square sectioned stub shaft 513 which is fixed to an insert 520 attached to the button 522, and within the slug 528, a cage 551, a barrel 552 and two pins 553, as shown most clearly in FIG. 13. The end wall 529 of the slug 528 has a pair of equispaced holes 554. The cage 551 is held rotationally within the slug 528, and the barrel 552 is located rotationally within the cage 551.

The cage 551 has a pair of longitudinal slots 555 at the bottom of longitudinal recesses 556 and the barrel 552 has a pair of spiral slots or grooves 557. The pins each have a detent 558 and these are located in the recesses with the detents protruding through the longitudinal slots 556 and into the spiral slots 557. They are held captive in position by the slug inner wall and aligned with the holes 554, and can slide longitudinally in and out of the holes 554. The stub shaft 513 passes slidably but non-rotationally through a square sectioned hole 559 in the barrel 552.

When the latch mechanism is operated by pushing the button 522, the stub shaft 513 simply slides through the hole 559 in the barrel 552. At the same time, the slug 528 rotates relative to the cage 551 and barrel 552 which remain stationary.

The lock mechanism is operated by turning the button 522 as before when it is in its rest position under the action of the spring 540. This has the effect of turning the stub shaft 513 which rotates the barrel 552. The cage 551 is prevented from rotating within the slug 528 by a pair of shoulders 561 (one of which is shown in FIG. 13). The shoulders 561 are similar to the ridges 117 in FIGS. 4 and 6. These shoulders 561 are engaged by the cage walls since the relative rotation would be in the opposite sense to that of the slug 528 rotating during operation of the latch mechanism.

The barrel 552 therefore rotates relative to the cage 551. This means that the spiral grooves 557 rotate relative to the longitudinal grooves 555. Engagement of the detents 558 with the grooves 557 will force the detents to follow the grooves. However as the pins 553 cannot rotate, they are forced by the detents to move longitudinally. As the pins 553 are aligned with the holes 554 in the slug end wall 529 and also with holes 562 in the fixed backing plate 512, so they are driven through these holes 554,562 as the detents travel along the grooves 555,557. This is shown most clearly in proceding from FIG. 14 to FIG. 15 as the shaft 513 is rotated as shown by arrow A.

When the pins 553 are extended in this way the slug 528 is rotationally locked with respect to the backing plate 512, thus directly preventing rotation of the slug 528 and so preventing operation of the latch mechanism. This contrasts with the embodiments described above in which the linear movement of the yoke 23 is prevented thereby preventing movement of the slug 28 indirectly.

The mechanism is unlocked by turning the button 522 in the other sense which turns the barrel 552 relative to the cage 551 until the pins 553 are withdrawn.

Clearly, the operation of either of the two locking mechanisms on each side of the door is quite independent of the other and so the door can be locked by either but must be unlocked by both to enable the latch operating mechanism to be released.

It will be appreciated that while various embodiments have been described individually, the differing variants or features thereof may be combined in any convenient manner to achieve any particular desired characteristics.

There is shown at FIGS. 16 and 17 the operation of a conventional latch set for use for example between the handles 10/10' shown in FIGS. 1 and 2. The operating parts of the latch set 600 comprise a bolt head 610 which is connected to a bolt frame 612. The bolt frame 612 is located within a housing 614 such that the bolt head 610 and bolt frame 612 can slide in the direction of the arrow marked S in the drawings. A spring 616 is provided to urge the bolt frame 612 and the bolt head 610 in the opposite direction to direction S. The bolt head 610 protrudes through a plate 618. There is a hole in the plate 618 which allows the bolt head 610 to pass through the plate 618 but prevents the bolt frame 612 from moving further to the left of the position which it appears in FIG. 17. The plate 618 would be located on an edge of a door 620, the housing 614 being located within a bore in the edge of the door, the axis of the bore being substantially parallel to the inner and outer faces of the door.

As will be seen best from FIG. 16 a rotatory element 624 is held captive between the upper and lower arms of the bolt frame 612. The rotatory element 624 comprises a cylinder 626 which has a square section bore 628 running through it. The square section bore 628 is dimensioned to receive the latch spindle 44 (see also FIG. 2).

Affixed to the cylinder 626 is a part annular flange 630 the tips of which protrude through slots 632 and 634 in the bolt frame 612.

The cylinder 626 extends on either side through holes not shown in lateral faces of the housing 614 with the result that the rotational element 624 is spacially fixed but may be moved rotationally by movement of the spindle 44. Movement of the spindle 44 for example in the sense of the arrow shown at T in FIG. 16 will cause the part of the annular flange 630 protruding through slot 632 to come into contact with the end face of the slot 632. Further movement of the spindle in the sense T will move the bolt frame 612 and the bolt head 610 in the direction S against the force of the spring 616. The bolt head 610 will therefore be retracted into the door to enable the door to be opened. Release of the spindle 614 will enable the spring 616 to return the bolt 610, 612 to the extended position.

We claim:

1. A latch operating set comprising: a latch set having a latch bolt and a rotational element; latch operating means having a linearly movable operating member and a rotationally movable latch operating member; interaction means comprising a helical thread on one operating member and a thread-engaging cam on the other operating member, said interaction means translating linear movement of said operating member into rotational movement of said latch operating member; a latch spindle between said latch operating member and said rotational element or rotation of said rotational element consequent on rotation of said latch operating member; and connector means located between said latch operating member and said spindle, said connector means and said latch operating means having rotary lost motion means therebetween.

2. A latch operating set according to claim 1 further comprising further latch operating means and locking means for the first latch operating means, in which connecting means are provided to connect the first and further latch operating means such that operation of the locking means for the first latch operating means restrains the further latch operating means from operation.

3. A latch operating set comprising: a latch set having a latch bolt and a rotational element; to latch operating means each having a linearly movable operating member and a rotationally movable latch operating member; interaction means having a thread on one operating member of each latch operating means and a thread-engaging cam on the other operating member of each latch operating means, said interaction means translating linear movement of said operating members into rotational movement of said latch operating members; a latch spindle disposed between said latch operating members of said two latch operating means and said rotational element for rotation of said rotational element consequent on rotation of said latch operating members; and connector means located between each of said latch operating means and said spindle, each said connector means and said latch operating means having rotary lost motion means therebetween whereby when one of said latch operating means is operated, the other latch operating means does not move.

4. A latch operating set comprising: locking means; a latch set having a latch bolt and a rotational element; two latch operating means each having a linearly movable operating member and a rotationally movable latch operating member; interaction means comprising a thread on one of the operating members of each latch operating means and a thread-engaging cam on the other operating member of each latch operating means, said interaction means translating linear movement of said linearly movable operating member into rotational movement of said rotationally movable latch operating member; a latch spindle disposed between said latch operating members of said two latch operating means and said rotational element for rotation of said rotational element upon rotation of said rotationally movable latch operating members; said locking means comprising a spacer movable between a first position allowing linear movement of said linearly movable operating member and a second position in which said spacer is located between said linearly movable operating member and said rotationally movable latch operating member so as to maintain linear separation thereof, thereby restraining linear movement of said linearly movable operating member with respect to said rotationally movable latch operating member; and means provided to connect said spacers such that movement of said spacer of one said linearly movable latch operating means causes movement of said spacer of the other said linearly movable latch operating means between its first and second positions.

5. A latch operating means improvement for operating a latch wherein the latch includes a spindle and a latch bolt retractable by rotation of the spindle, the improvement in the latch operating means comprising:

a first operating member for operating a spindle;

means for mounting the first operating member for linear movement;

a second operating member;

means for mounting the second operating member for rotary movement;

lost motion connection means between the second operating means and the spindle wherein when the second operating means rotates in a first direction the spindle rotates and when the spindle itself rotates in the first direction the second operating means does not rotate, and interaction means including a helix means on one of the operating members and a cam on the other operating member, wherein the cam engages the helix means, whereby when the first operating member moves linearly, the second operating member rotates and drives the spindle to rotate via the lost motion connection.

6. The latch operating means according to claim 5 in which said lost motion means comprises a cylindrical recess in the second member with a part-annular radial extension and a cylinder with a radially extending lug for mounting on a spindle, said cylinder being mounted for rotation in said recess and said lug being located within said radial extension for angular movement therein.

7. Latch operating means according to claim 5 in which said helix means is a groove and said cam is a bearing comprising a pin having a roller bearing around its circumferential surface.

8. Latch operating means according to claim 5 in which said helix means is a groove and said cam is a bearing, said groove being located in said second operating member, said first operating member having a recess with a ball bearing located between said groove and said recess.

9. Latch operating means according to claim 5 in which said helix means has a non-constant helix angle.

10. Latch operating means according to claim 5 having locking means to restrain rotation of said second operating member.

11. Latch operating means according to claim 10 in which said locking means acts on said first operating member to restrain linear movement thereof.

12. Latch operating means according to claim 5 in which said lost motion means comprises a cylindrical recess with a part annular radial extension, and a cylinder with a radially extending lug, said cylinder being located for rotation in said recess and said lug being located within said radial extension for angular movement therein.

13. The latch operating means improvement according to claim 5 further including locking means engaging the first operating member for selectively restraining linear movement of the first operating member, said locking means comprising a spacer movable between a first position allowing linear movement of said first operating member and a second position in which said spacer is located between said first operating member and said second operating member so as to maintain linear separation thereof and thereby restrain linear movement of said operating members with respect to said latch operating member.

14. The latch operating means according to claim 13 in which said spacer is located rotationally between said first operating member and said second operating member, said first operating member and said second operating member defining between them a recess, said spacer and said recess being configured such that said spacer in a first rotational position may move linearly into said recess to allow linear movement of said first operating member with respect to said second operating member while preventing such when in a second rotational position.

15. Latch operating means according to claim 5 further including locking means in which said locking means are located on said second operating member, said locking means being movable from a first position allowing rotational movement of said second operating member and a second position in which said locking means engages a rotationally fixed member of said second operating member to restrain rotational movement of said second operating member.

16. Latch operating means according to claim 15 in which said locking means comprises a pin located within said second operating member and spaced from the axis thereof, said pin being movable between a first retracted position and a second position in which it extends out of the second operating member into engagement with a rotationally fixed member of the second operating member to restrain rotational movement of the second operating member.

17. Latch operating means according to claim 16 in which a rotational locking member is provided within said second operating member, said rotational locking member and said pin having interacting means therebetween comprising an interacting thread on said locking member and thread-engaging cam on said pin, rotational movement of said rotational locking member being transferred to linear movement of said pin by said interacting means.

18. The latch operating means improvement according to claim 5 in which said lost motion means comprises a cylindrical recess with a part-annular radial extension; and a cylinder with a radially extending lug, said cylinder being located for rotation in said recess and said lug being located within said radial extension for angular movement.

19. The latch operating means improvement according to claim 5 in which said helix means is a groove and said cam is a bearing, said cam comprising a pin having a roller bearing around its circumferential surface.

20. Latch operating means according to claim 5 in which said helix means has a helix axis and a helix angle, the helix angle being non-constant with respect to the helix axis.

21. An improvement in latch operating means for operating a latch, wherein the latch with which the improvement is to be utilized includes a latch bolt, manipulating means connected to the latch bolt for projection of and withdrawing of the latch bolt and a spindle connected to the manipulating means to operate the manipulating means upon rotation of the spindle, the improvement comprising:

a pair of opposed housings for mounting on opposite sides of a closure, the housings each having an opening therethrough and each having a pair of opposed tracks facing the opening;

a sliding operating member in each housing, each sliding operating member comprising a knob portion which projects from the housing and a yoke which extends back into the housing, the yoke having a pair of arms which are received in the tracks to restrain the sliding operating member from rotation when moved linearly by pressing the knob portion and the arms having cams thereon projecting inwardly therefrom;

a rotating operating member in each housing, the rotating operating member being mounted between the arms of the yoke in the housing and having helical grooves therein for receiving the cams the helical grooves of each rotating operating member having the same slope when viewed from the direction of the associated knob portion, wherein when the sliding operating member is moved linearly by pressing on the knob projecting from the housing, the rotating operating member rotates in a first direction determined by the slope of the helical grooves thereof, and lost motion connection means for connecting each rotating operating member to the spindle, each lost motion connection means including means for coupling the respective rotating operating member to the spindle when the rotating operating member rotates in the first direction, and for rotatably decoupling the rotating operating member from the spindle when the spindle is rotated in a second direction opposite the first direction as viewed from the associated knob, whereby the knob portions of the sliding operating member projecting from the opposed housings are mechanically isolated from one another so that pressing one knob portion to retract the latch bolt does not move the other latch member.

22. The improvement of claim 21 further including spring means for biasing the sliding operating members away from the rotating operating members and opposed surfaces on the housing and sliding operating members for retaining the sliding operating members within the housing.

23. The improvement of claim 22 further comprising handle means projecting laterally from the housing adjacent the knob portion of the sliding operating member.

24. The improvement of claim 23 further including a locking mechanism operable from the knob portion of at least one sliding operating member, the locking mechanism comprising means for rotatably mounting the knob portion of the sliding operating member on the yoked member wherein rotation of the knob member operates the locking mechanism, the locking mechanism including means for blocking selectively sliding motion of the sliding operating means and means connecting the knob portion of the sliding operating member to the blocking means for rotating the blocking means into blocking position.

* * * * *